US005493612A

United States Patent [19]

Klund et al.

[11] Patent Number: 5,493,612

[45] Date of Patent: Feb. 20, 1996

[54] SECURE COMMUNICATION KEYING SYSTEM

[75] Inventors: William E. Klund; Woodrow H. Littrell; Robert D. Isaak, all of San Diego; Richard G. Stephenson, Rolling Hills, all of Calif.

[73] Assignee: The United States of America as represented by the Secretary of the Navy, Washington, D.C.

[21] Appl. No.: 183,696

[22] Filed: Mar. 27, 1962

[51] Int. Cl.[6] ..... H04K 1/02

[52] U.S. Cl. ..... 380/6; 375/200; 375/218; 367/134; 380/34; 380/46; 380/59

[58] Field of Search ..... 340/5, 5 T, 6; 343/100.7, 204, 205, 206, 207, 208; 325/28, 30, 32, 33, 34, 40, 44, 61, 122, 139, 163; 178/5.1; 375/1, 6; 380/6, 8, 33, 34, 38–40, 46, 59; 367/134

[56] References Cited

U.S. PATENT DOCUMENTS

| | | | |
|---|---|---|---|
| 1,542,565 | 6/1925 | Mathes | 325/33 |
| 2,423,546 | 7/1947 | Bedford | 179/1.5 |
| 2,643,369 | 6/1953 | Manley | 325/44 X |
| 2,718,638 | 9/1955 | De Rosa et al. | 343/113 |
| 2,941,202 | 6/1960 | Harris, Jr. et al. | 343/101 |
| 3,016,519 | 1/1962 | Linder | 340/171 |
| 3,020,399 | 2/1962 | Hollis | 325/30 |

*Primary Examiner*—Bernarr E. Gregory
*Attorney, Agent, or Firm*—William C. Townsend; Edward J. Connors, Jr.; Kenneth W. Dobyns

[57] ABSTRACT

The secure communication keying system has a noise generator whose output is a predetermined finite band of noise within, for example, the zero to eleven hundred cycle per second range. The noise generator may be a pseudorandom noise generator that is synchronized with a given clock frequency. The output of the system may have noise-like characteristics, but it is encoded with any type of intelligence desired to be transmitted. The output signals simulate the ambient noise occurring within the communication medium and has the same frequency spectrum regardless of the frequency of the modulating signals supplied thereto.

4 Claims, 2 Drawing Sheets

SECURE COMMUNICATION KEYING SYSTEM

The invention described herein may be manufactured and used by or for the Government of the United States of America for governmental purposes without the payment of any royalties thereon or therefor.

The present invention relates in general to communication systems and in particular is a secure sonar system for cryptographically communicating between vessels by means of signals that are keyed at such a rate as to make them substantially undetectable to an interceptor.

In the past, communication signals between vessels with sonar apparatus has been accomplished by means of transmitting coherent signals having unique by detectable waveforms which may be processed and perhaps decoded by the sonars of enemy or other vessels. Even though in some instances decoding was necessary to the complete understanding of any messages being sent, the keying of such coded transmitted signals alone within the environmental medium was sufficient to warn the enemy that vessels were communicating in the immediate vicinity. This is due to the fact that detection thereof was easily distinguished from the ambient quiet environmental communication medium or the ambient noise and other signals inherently existing within the communication medium, inasmush as the broadcast signals had to be of such power and character to over-ride both as well as other normal attentuation factors. When the background noise found throughout the oceans, seas, and lakes is involved, it can readily be appreciated the situation may become aggravated when such is the communication medium. For instance, the presence of living organisms therein, the intermolecular movement of the fluid and its solutes, reverberations, and other physical and chemical properties are all adverse factors which must be minimized and over-ridden before satisfactory communication between vessels can be effected. To date, for many practical purposes it has been substantially impossible to over-ride these factors and still produce a cryptographic type communication signal that is not easily detectable by most any interceptor that is searching for and attempting to process it with apparatus having some degree of sophistication.

On the other hand, if it were possible to use encoded communication signals that are appropriately keyed to resemble the aforesaid noise signals and give appearance that no keying thereof is actually occurring and still be detectable and understood by complementary communicating friendly vessels, the security of communication and the safety of the communicating vessels would be greatly enhanced, due to the likelihood that the communicated intelligence would be unknown to enemy vessels or at least reduced considerably. The instant invention makes this possible and, moreover, does it simply and efficiently with a minimum of expensive equipment.

It is, therefore, an object of this invention to provide an improved secure communication system.

Another object of this invention is to provide an improved sonar communication system.

Another object of this invention is to provide an improved method and means of keying communication signals to make them substantially undetectable and unintelligible to enemy monitors.

Still another object of this invention is to provide an improved noise correlation type of communication system.

A further object of this invention is to provide a method and means for broadcasting signals which are only detectable and discernible by complementary cooperating communication receivers adapted for so doing.

A further object of this invention is to provide a method and means for broadcasting and receiving keyed pseudo noise signals simulating the ambient noise signals inherently occurring within the communication medium.

Another object of this invention is to provide a predetermined keyed communication signal that may only be detected by cross correlation thereof with a reference keyed signal having exactly the same time-signal sequence.

Another object of this invention is to provide a method and means for producing an output signal having the same frequency spectrum regardless of the frequency of the modulating signals supplied thereto.

Still another object of this invention is to provide a method and means for supplying and filtering a plurality of keyed signals to obtain a constant band of signal frequencies that are narrower than that of the supplied signals and contains a continuous spectrum thereof.

Another object of this invention is to provide a secure communication system having a high data rate.

Still another object of this invention is to provide an increased search rate between communicating vessels or in target echo-ranging operations.

Another object of this invention is to provide an improved cryptographic sonar communication system that may be easily and economically constructed and maintained.

Other objects and features of this invention will become apparent to those skilled in the art as the disclosure thereof presented in the following detailed description is considered in conjunction with the accompanying drawings in which.

Figure 1:
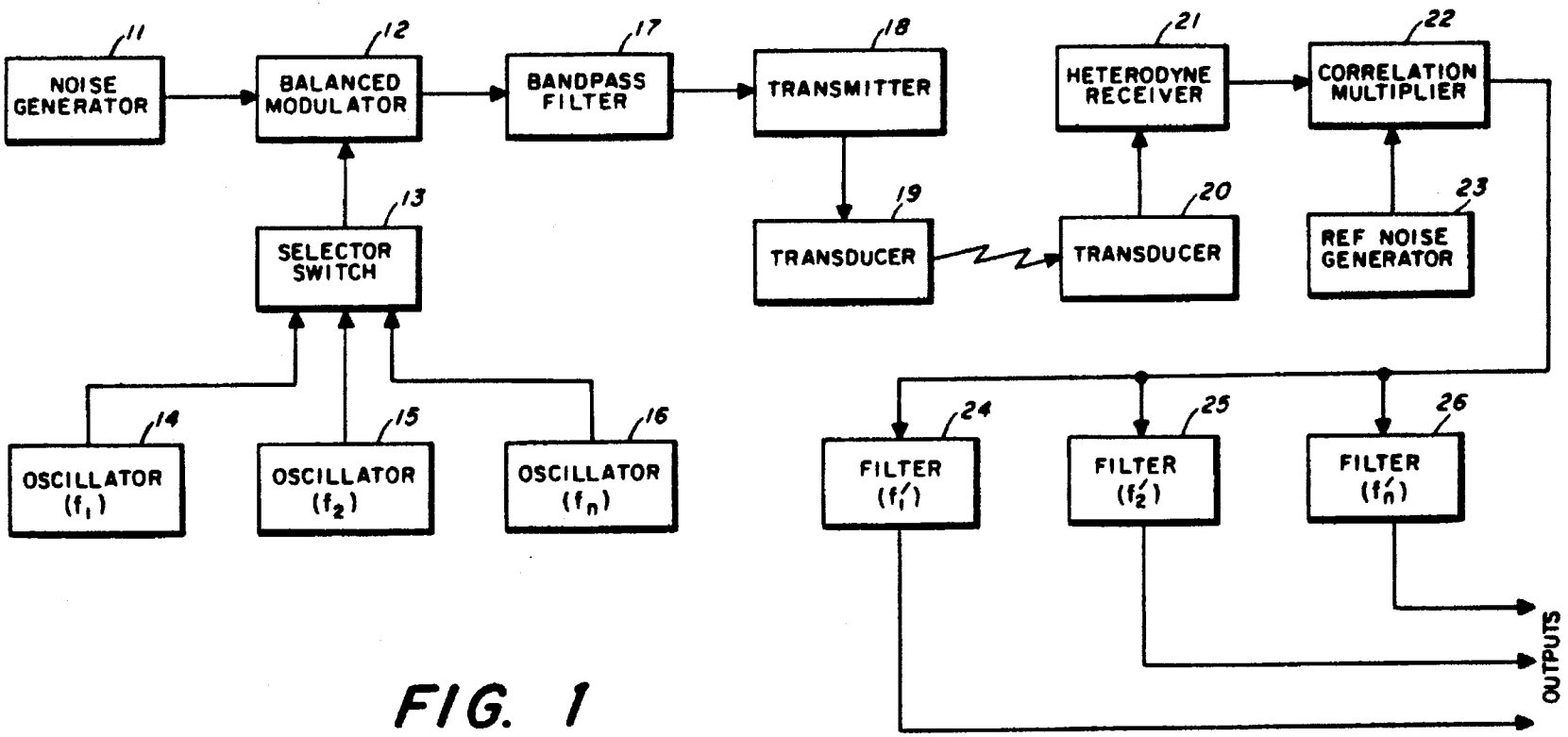
FIG. 1 is a block diagram of a preferred embodiment of the subject invention.

Referring now to FIG. 1, there is shown a secure communication keying system having a noise generator 11 whose output is a predetermined finite band of noise within, for example, the zero to eleven hundred cycle per second range. Said noise generator may, for instance, be a pseudo-random noise generator that is synchronized with a given clock frequency. It may produce an output signal that has noise-like characteristics but is programmed by encoding in accordance with any predetermined intelligence desired to be transmitted or communicated.

The output of noise generator 11 is applied to one of the inputs of a balanced modulator 12, the outer input of which is supplied by the output of a selector switch 13 which, in turn, has a plurality of inputs applied thereto by the outputs of any given number of oscillators, such as oscillators 14, 15 and 16. Said oscillators, of course, each have their own individual output frequency, as will be more fully explained subsequently, but preferably the frequencies thereof should be very nearly the same.

The output of balanced modulator 12 is applied to the input of a bandpass filter 17 which is sufficiently narrow with respect to said combined oscillator and noise generator frequencies and has high enough attenuation outside the pass band to cause the output signal therefrom to have the same frequency spectrum regardless of which of the aforesaid local oscillators 14, 15 or 16, is being used for keying. A transmitter circuit 18 receives its input from bandpass filter 17 and, in turn, actuates a transmitting transducer 19 in accordance therewith.

Transducer 19 may be any appropriate transducer which will convert electrical energy into the type of energy to be broadcast throughout the environmental communication medium. Thus, the preferred embodiment of the subject secure communication keying system of this invention may either be of electroacoustical energy type or of the electromagnetic energy type. Transducer 19 and the aforesaid transmitter 18 driving same should appropriately be selected accordingly. Assuming for the purpose of this disclosure, however, that the subject system is a cryptographic sonar communication keying system, it should be obvious that transducer 19 would ordinarily be of an electroacoustical type that may be submerged in sea water or any other subaqueous medium for broadcast of acoustical energy therethrough.

A receiving transducer 20 which is substantially similar to transmitting transducer 19 receives its input from said transducer 19. The output thereof is then supplied to a receiver 21 which is preferably of the heterodyne type (but need not be such if so desired), the output of which, in turn, is coupled to one of the inputs of a correlation multiplier 22. The other input to correlation multiplier 22 is supplied by a reference noise generator 23, the output of which is identical in time sequence and waveform to the output signal of the aforementioned noise generator 11. Again, it should be understood, that reference noise generator 23 may be of the pseudorandom noise type which contains an output signal that is programmed or encoded to facilitate correlation thereof with the intelligence to be communication, and it, too, may be synchronized with a given clock frequency if desirable. Of course, the only qualifying factors involved in the selection of both noise generator 11 and reference noise generator 23 is that they both produce identical output signals.

The output of correlation multiplier 22 is applied to a plurality of filters which are equal in number to aforesaid plurality of oscillators, each of which respectively filters the output frequencies thereof. While each of these filters corresponds to an oscillator (14, 15 and 16, respectively), the center frequency of each is determined by the frequency shift encountered in the heterodyne receiver as well as the oscillator frequency and, therefore, is herewith represented, for example, as being $f_1'$, $f_2'$, and $f_n'$, respectively. One possible embodiment would employ a straight receiver with no frequency heterodyning and thus filter 24 would have the same frequency as oscillator 14, 25 the same as oscillator 15 and so on.

Figure 2:
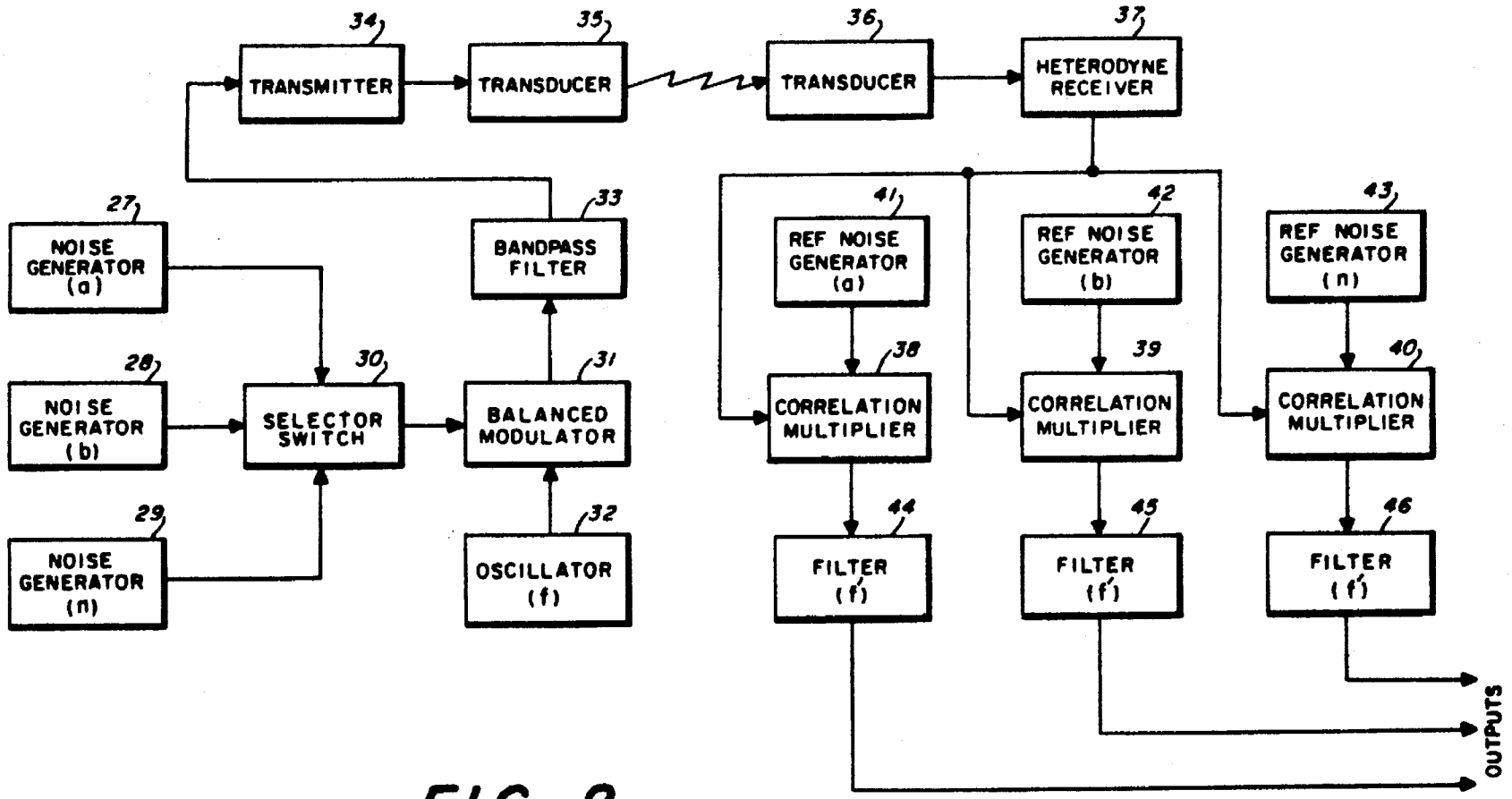
FIG. 2 is a block diagram of another preferred embodiment of the subject invention.

Referring now to preferred embodiment of the secure communication keying system shown in FIG. 2, there is shown a plurality of noise generators consisting of, for example, a noise generator 27, a noise generator 28, and a noise generator 29. While only three of such generators are disclosed herein for the purpose of simplifying the explanation of this invention, it should be understood that any preferred number thereof may be employed as necessary to provide a desired communication result. Any of said noise generators may be coupled through a selector switch 30 at will to one of the inputs of a balanced modulator 31, the other input of which is supplied by the output of an oscillator 32 which produces a signal having some predetermined frequency, f. Intelligence is conveyed by moving the selector switch from one noise generator to another as needed in order to send the desired message.

The output of balanced modulator 31 is coupled through a bandpass filter 33 having an appropriate bandpass spectrum sufficient for passing the upper sideband of the signals comprising the product mixture of the aforesaid noise generator output signals taken separately and said oscillator output signal. The output of bandpass filter 33 is coupled through a transmitter circuit 34 to a transducer 35 for broadcast through a subaqueous or other environmental medium to another transducer 36.

The output of transducer 36 is connected to preferably a heterodyned receiver 37 for appropriate processing therein and then to one of the inputs of each of a plurality of correlation multipliers 38, 39 and 40, the number of which is identical to the number of the aforementioned noise generators. The other inputs to each of said correlation multipliers 38, 39 and 40 are respectively supplied by reference noise generators 41, 42, and 43. These reference noise generators are likewise identical to noise generators 27, 28 and 29, respectively, in that they produce identical output signals therewith in exactly the same time sequence.

The lower sideband outputs of each of the aforesaid correlation multipliers 38, 39 and 40 are respectively coupled to the inputs of filters 44, 45 and 46. These filters will all be identical and are so designed as to pass the appropriate frequency f', as determined by the oscillator 32 and the frequency shift (if any) imparted by the hetrodyne receiver. If this shift is chosen to be zero in the design, then these filters would pass frequency f equal to the oscillator frequency.

In event it is desired to omit the aforementioned oscillator 32, the subject invention will still function in an acceptable manner without adversely affecting the secure keying operations. However, if this is done, it should be noted that the outputs from filters 44, 45 and 46 will be direct current signals provided that a straight receiver is used (i.e. no frequency shift due to hetrodyning).

It should also be understood that is it is desired to process and filter output signals from the aforementioned correlation multipliers containing doppler, each of filters 44, 45 and 46 may be replaced with a suitable set of comb filters having proper center frequencies without violating the teaching and scope of this invention.

The methods and systems constituting this embodiment of the subject invention actually provide several very desirable features as follows:

First, in order to obtain many channels and thus a high data rate, any number of noise generators can be employed without increasing the frequency bandwidth of the transmitter filter input. This greatly simplifies the filter problem, since this filter must have a very linear phase characteristic in order to achieve high system processing gain.

Second, the opportunity for increasing the search rate by use of multiple receiving correlators is available.

Prior to the transmission of a message over the subject types of secure keying communication systems, it is ordinarily essential to insert a time delay in the reference noise generators equivalent to the signal propagation time. When communicating between mobile stations, so doing may become a relatively slow and somewhat inefficient process because of the amount of delay that usually has to be gradually inserted in order to obtain the correct value required for correlation at whatever particular range the stations happen to have at the moment. Of course, this search-correlation operation may be expedited by using any appropriate range finding apparatus to ascertain the distance between the communicating vessels and then manually or automatically roughly adjusting or delaying the receiving noise generator output signals accordingly to effect proper correlation. However, even then, additional fine adjustment may be necessary to obtain optimum correlation, especially if there is continuous relative movement between the communicating vessels.

Thus, the subject system is capable of establishing communication during the search or acquisition phase thereof by merely transmitting a single predetermined character or signal long enough to allow the receiving station to set the time delay of the reference generator outputs to such a value that said single character or signal is displayed on the correct output or readout device, thereby indicating that correlation has been accomplished and that message communication is possible. Such a single signal or character may originate as outputs of any of the aforementioned noise generators or oscillators, or other suitable apparatus as desired. Likewise, correlation thereof may be effected by any of the receiving reference noise generator outputs or other reference signals generator outputs as convenient or preferred. This procedure provides the essential search and acquisition operations which are required prior to message transmittal. Furthermore, by employing the method described by FIG. 2 it should be noted that if the reference generators all produce identical noise sequences which are respectively staggered in time by successive intervals of t seconds, it is possible to search n time delay intervals (where n represents the number of reference noise generators used) in the same time that it would otherwise take to search a single interval of t seconds. Of course, the transmitter noise sequence chosen for the search process would likewise have to be identical to the reference sequences and would have to be time synchronized with a particular one of the reference sequences. For the purpose of communicating messages it will also be necessary for all other transmitter noise sequences to be respectively staggered in time by successive intervals of t seconds. Thus, the transmitter sequences are identical to and respectively time synchronized with the reference sequences.

Inasmuch as each of the components represented by the individual blocks detected in FIGS. 1 and 2 are conventional per se and all are well known in the electronic art, it should be understood that it is their unique arrangement and interaction which causes the new and improved communications keying results to be produced and, thus, constitutes the subject invention.

The operation of the subject invention as embodied in the device of FIG. 1 briefly is as follows:

In order to gain the utmost in cryptographic security, a coded noise communication system must be keyed in such a way as to make the keying rate as undetectable as possible to an enemy interceptor. In noise correlation types of communication systems, this may be achieved by heterodyning a finite band of noise in such manner as to cause it to occupy a different portion of the frequency spectrum. This is done by mixing it with the outputs of one of several local oscillators in a balanced modulator. Thus, in this case, the noise output signal of noise generator 11 is selectively mixed with signals $f_1$, $f_2$ or $f_n$ from oscillators 14, 15 or 16 by selectively supplying any one thereof to balanced modulator 12 by means of selector switch 13. The desired portion of the upper sideband is then separated out of the output of balanced modulator 12 by bandpass filter 17. This filtered sideband is then supplied to transmitter circuit 18 which appropriately processes it for broadcast throughout the environmental communication medium by means of transducer 19.

Actually, the uniqueness of this system, which differentiates it from standard frequency shift keying, lies in making the local oscillator frequencies very nearly the same and the bandpass filter sufficiently narrow with respect thereto and with sufficiently high attentuation outside of the passband to cause the output signal therefrom to have the same frequency spectrum regardless of which local oscillator is being keyed. Typical values of $f_1$ and $f_2$ might be 1450 and 1454 cycles per second, respectively, and the corresponding passband filter limits could be set at 1500 to 2500 cycles per second.

Since the output signal from the bandpass filter 17 has a frequency spectrum which is independent of the keying frequency, the only known method of reading the keyed message or, in fact, determining that the signal is keyed at all, is by means of cross correlation of the signal passed by bandpass filter 17 with a reference noise generator which reproduces the exact time sequence of the transmitted noise signal. For this purpose, a receiver transducer 20 is used to pick up said broadcasting, whereupon it is processed as necessary to be useful in heterodyne receiver 21 and applied to correlation multiplier 22. After being mixed in correlation multiplier 22 with the references noise signal generated from reference noise generator 23, it is applied to each of filters 24, 25 and 26, each of which, for instance, may be separated by four cycles per second. It can thus be seen that since each filter respectively passes the frequency proportional to the aforementioned oscillators 14, 15 and 16, the outputs therefrom are indicative of the messages being broadcast by transducer 19. In other words, the receiving vessel will know which message is being communicated by the transmitting vessel merely by being cognizant of which filter is producing an output signal at any particular time, and this, of course, may be determined by any suitable conventional readout means.

As previously mentioned, receiver 21 may incorporate a heterodyne stage or not as desired. But if the heterodyne stage is employed, it will effect lowering the signal frequencies at the correlation multiplier output, thereby simplifying design of the filter or filters by separating the design pass frequency thereof from a percentage frequency consideration, i.e., the filters 24, 25 and 26 may be 4 cycles per second and separated by 4 cycles per second center to center. At about 1500 cps, without heterodyning their percentage bandwidth is very small, while by using heterodyning to produce center frequencies in the vicinity of 100 cps, the percentage bandwidth and thus filter cost becomes quite modest.

It should be understood, of course, that the outputs from the aforesaid filters 24, 25 and 26 may be coupled to any appropriate readout instrumentation such as volt meters, recorders, oscilloscopes, oscillographs, computers, or the like.

The device constituting the preferred embodiment of the invention depicted in FIG. 2 operates according to the same philosophy of operation used to obtain security of communication with the device of FIG. 1. In this case, however, two or more noise generators which produce the same noise spectrum but different sequences are used in conjunction with a single local oscillator. Thus, it can be seen that the outputs of noise generators 27, 28 and 29 are selectively applied to balanced modulator 31 by means of selector switch 30. A modulating signal of any preferred frequency is supplied as well to balanced modulator 31 for mixing therewith by means of oscillator 32. Again the upper sideband from balanced modulator 31 is filtered in bandpass filter 33 in a manner substantially similar to the filtering process explained in connection with the device of FIG. 1. After filtering the output from bandpass filter 33 it is applied to transmitter 34 where it is appropriately processed in preparation for being supplied to and broadcast by transducer 35.

Another transducer 36 located on the receiving vessel picks up the signal broadcast by transducer 33 from the environmental medium within which communication is taking place and supplies it to receiver 37 for appropriate processing therein before being fed to correlation multipliers 38, 39 and 40. In these correlators, the various characters of said signals are separated out by correlating or taking the voltage product of the received signal and the signal from the appropriate reference noise generator such as reference noise generator 41, reference noise generator 42, or reference noise generator 43, illustrated in this embodiment. The outputs of correlator multipliers 38, 39 and 40 are respectively filtered in filters 44, 45 and 46, each of which pass the signals having the same frequency f'.

Again the outputs of said filters may be applied to any appropriate readout instrumentation which will indicate and/or record which of the filters are producing an output signal and, accordingly, which of the intelligence signals are being broadcast by the communicating vessel.

Obviously many modifications and variations of the present invention are possible in the light of the above teachings. It is, therefore, to be understood that within the scope of the appended claims, the invention may be practiced otherwise than as specifically described.

What is claimed is:

1. A secure communication keying system comprising in combination, a plurality of local oscillators each of which produce a different frequency output signal, a noise generator, a balanced modulator having a pair of inputs one of which is connected to the output of said noise generator, a selector switch interconnecting the other input of said balanced modulator and the output of each of said plurality of local oscillators, a filter coupled to the output of said balanced modulator, said filter having a pass band that is sufficiently narrow with respect to the combined oscillator and noise generator frequencies and has high enough attenuation outside said pass band to cause the output signal therefrom to have the same frequency spectrum regardless of each of said local oscillators is connected to said balanced modulator by the aforesaid selector switch at any given instant, a transmitter coupled to the output of said filter, a first transducer connected to the output of said transmitter adapted for broadcasting a communication signal throughout a predetermined environmental medium, a second transducer spatially disposed from said first transducer and adapted for receiving the communication signal broadcast thereby, a receiver coupled to the output of said second transducer, an adjustable reference noise generator adapted for timely producing a delayed replica of the output of the aforesaid noise generator, a correlation multiplier having a pair of inputs one of which is connected to the output of said receiver and the other of which is connected to the output of said adjustable reference noise generator, and a plurality of filters equal in number to the aforesaid plurality of local oscillators with each thereof having pass frequencies respectively comparable thereto.

2. A secure communication keying system comprising in combination, a plurality of pseudorandom noise generators, an oscillator for producing an output signal of predetermined frequency, a balanced modulator having a pair of inputs one of which is connected to the output of said oscillator, a selector switch interconnecting the other input of said balanced modulator and the output of each of said plurality of noise generators, a bandpass filter coupled to the output of said balanced modulator, a transmitter coupled to the output of said bandpass filter, a first transducer connected to the output of said transmitter adapted for broadcasting a communication signal throughout a predetermined environmental medium, a second transducer spatially disposed from said first transducer and adapted for receiving the communication signal broadcast thereby, a receiver coupled to the output of said second transducer, a plurality of adjustable reference noise generators equal in number to the aforesaid plurality of noise generators and adapted to respectively produce delayed replicas of the outputs thereof, a like plurality of correlation multipliers each of which has a pair of inputs one of which is interconnected and coupled to the output of said receiver and the other of which is respectively coupled to the outputs of said adjustable reference noise generators, and comb filter means connected to each of the outputs of said plurality of correlation modulators and adapted for passing signals at the center thereof that have a frequency comparable to the frequency of the output of the aforesaid oscillator.

3. A method of keying a sonar communication system to prevent detection thereof by unwanted monitors comprising the combined steps of generating a plurality of predetermined signals, selectively mixing each of said plurality of predetermined signals with a unique predetermined signal, filtering said mixed signals to exclude all signals except those within a pass band sufficiently narrow to cause the output thereof to have the same frequency spectrum regardless of the respective frequencies of the aforesaid mixed signals, broadcasting said filtered signals within a subaqueous communication medium, receiving said broadcast signals from said subaqueous communication medium, timely demodulating said received signals an amount same was originally modulated, and filtering said demodulated signals to effect an output signal having a frequency that is identical with the frequency of one of the aforesaid mixed signals.

4. A secure communication system comprising in combination, at least one pseudorandom noise generator for generating an extremely narrow frequency spectrum output signal, at least one oscillator means having an output signal, modulating means operatively connected to said at least one noise generating means and to said at least one oscillator means for mixing the output signals therefrom and producing a finite narrow band of noise within which said oscillator output signal is effectively mask, narrow band filter means operatively connected to the output of said modulating means for selecting a single sideband therefrom, means coupled to the output of said narrow band filter means for effectively broadcasting said selected single sideband throughout a predetermined environmental medium, means spatially disposed from said broadcasting means for effectively receiving the selected single sideband broadcast thereby, at least one reference pseudorandom noise generator having an output signal corresponding to the output signal generated by the aforesaid pseudorandom noise generator, and demodulating means operatively connected to the outputs of said at least one reference pseudorandom noise generator and said receiving means for producing an output signal corresponding to the output signal of the aforesaid at least one oscillator means.

* * * * *